US012188472B2

(12) United States Patent
Liu et al.

(10) Patent No.: US 12,188,472 B2
(45) Date of Patent: Jan. 7, 2025

(54) ROTOR ASSEMBLY, COMPRESSOR AND AIR CONDITIONER

(71) Applicant: Gree Electric Appliances, Inc. of Zhuhai, Guangdong (CN)

(72) Inventors: Hua Liu, Guangdong (CN); Zhiping Zhang, Guangdong (CN); Xiaokun Wu, Guangdong (CN); Yushi Bi, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 0 days.

(21) Appl. No.: 18/267,978

(22) PCT Filed: Oct. 19, 2021

(86) PCT No.: PCT/CN2021/124648
§ 371 (c)(1),
(2) Date: Jun. 16, 2023

(87) PCT Pub. No.: WO2022/179134
PCT Pub. Date: Sep. 1, 2022

(65) Prior Publication Data

US 2024/0110565 A1 Apr. 4, 2024

(30) Foreign Application Priority Data

Feb. 26, 2021 (CN) ..... 202110219320.6

(51) Int. Cl.
*F04C 18/16* (2006.01)
*F04C 18/08* (2006.01)
(Continued)

(52) U.S. Cl.
CPC ..... *F04C 18/16* (2013.01); *F04C 18/08* (2013.01); *F04C 18/084* (2013.01); *F04C 18/20* (2013.01);
(Continued)

(58) Field of Classification Search
CPC .... F04C 18/16; F04C 18/084; F04C 29/0021; F04C 2230/91; F04C 2240/20; F04C 18/20
See application file for complete search history.

(56) References Cited

U.S. PATENT DOCUMENTS 2,460,310 A * 2/1949 Rathman ..... F01C 1/16 418/200
2,620,968 A * 12/1951 Nilsson ..... F04C 18/16 418/190
(Continued)

FOREIGN PATENT DOCUMENTS

CN 87100486 A 8/1988
CN 1010333 B 11/1990
(Continued)

OTHER PUBLICATIONS

English Machine Translation of CN10103338B (also published as CN87100486A) translated via Google Patents on Feb. 28, 2024 (Year: 1988).*
(Continued)

*Primary Examiner* — Mary A Davis
(74) *Attorney, Agent, or Firm* — The Webb Law Firm

(57) ABSTRACT

A rotor assembly, a compressor and an air conditioner. The rotor assembly includes a first rotor, including a first working portion and a second working portion coaxially arranged, the first working portion and the second working portion are rotatable about a first axis; the first working portion includes a plurality of first helical blades, with a first blade groove being formed between adjacent two of the plurality of first helical blades; at least one first air pressure groove is provided on a first end face of the first working portion away from the second working portion.

13 Claims, 3 Drawing Sheets

(51) Int. Cl.
*F04C 18/20* (2006.01)
*F04C 29/00* (2006.01)
*F25B 1/047* (2006.01)

(52) U.S. Cl.
CPC ..... *F04C 29/0021* (2013.01); *F25B 1/047* (2013.01); *F04C 2210/1005* (2013.01); *F04C 2230/91* (2013.01); *F04C 2240/20* (2013.01)

(56) References Cited

U.S. PATENT DOCUMENTS 2,691,482 A * 10/1954 Ungar ..... F04C 23/001 418/199
3,807,911 A * 4/1974 Caffrey ..... F04C 18/084 418/9
4,770,615 A * 9/1988 Fujiwara ..... F04C 18/16 418/201.1
6,485,279 B2 11/2002 Zhong et al.
2020/0240411 A1* 7/2020 Foerster ..... F04C 18/16
2020/0408209 A1* 12/2020 Lepak ..... F04C 18/0215

FOREIGN PATENT DOCUMENTS

CN 101900119 A 12/2010
CN 110206729 A 9/2019
CN 110397589 A 11/2019
CN 112780551 A 5/2021
CN 112780553 A 5/2021
DE 3810505 A1 10/1989
DE 102011118050 A1 5/2013
KR 101408674 B1 7/2014

OTHER PUBLICATIONS

EP 21927558, Extended European Search Report, Apr. 16, 2024.

* cited by examiner

ROTOR ASSEMBLY, COMPRESSOR AND AIR CONDITIONER

CROSS-REFERENCE TO RELATED APPLICATIONS

This application is the United States national phase of International Application No. PCT/CN2021/124648 filed Oct. 19, 2021 and claims priority to Chinese Patent Application No. 202110219320.6, filed Feb. 26, 2021, the disclosures of which are hereby incorporated by reference in their entirety.

BACKGROUND OF THE INVENTION

Field of the Invention

The present disclosure relates to the field of compressor technology, and more particularly, to a rotor assembly, a compressor, and an air conditioner.

DESCRIPTION OF THE INVENTION

Compressors are widely used in aerodynamics, refrigeration air conditioners and various technological processes because of their compact, efficient, reliable and adaptable characteristics, and their market shares continue to expand. As a new compressor structure, a four-rotor compressor is different from traditional compressors in that two pairs of double compressor rotors are symmetrically arranged on end faces of its suction orifice. Equivalent to two compressors in parallel, a single four-rotor compressor sucks air from a radial suction orifice in a middle of the four-rotor compressor and exhausts the air from exhaust orifices at two ends thereof. Due to the opposed and counter-rotational arrangement of the four rotors, axial forces of the four-rotor compressor may be completely counteracted under ideal conditions, and thus thrust bearings can be completely eliminated to realize further miniaturization of the compressor.

However, due to differences existing in actual processing and assembly processes of the four rotors, the axial forces cannot be completely counteracted when the four rotors run after being formed, which may produce random gas axial forces along two axial directions on the rotors of the compressor. Therefore, it is required to arrange two sets of thrust bearings having opposite bearing directions to ensure that the gas axial forces randomly appearing in the two directions are borne. However, for one individual compressor, the direction of its random resultant force of the axial forces is always unchanged. In this case, one set of thrust bearings is used for limiting, while the other set of thrust bearings is completely idle, thus resulting in lower price-performance ratio. Furthermore, redundant mechanical losses and demands for lubricating oil are incurred, and a failure rate of the compressor is increased.

SUMMARY OF THE INVENTION

Embodiments of the present disclosure provide a rotor assembly, a compressor and an air conditioner, to reduce costs of the compressor, simplify structures of moving parts of the compressor, and improve performance and reliability of the compressor.

A first aspect of the present disclosure provides a rotor assembly, which includes:

a first rotor including a first working portion and a second working portion coaxially arranged, where the first working portion and the second working portion are rotatable about a first axis, the first working portion includes a plurality of first helical blades, a first blade groove is formed between adjacent two of the plurality of first helical blades, at least one first air pressure groove is provided on a first end face of the first working portion away from the second working portion, and the first air pressure groove is configured to form a force in a predetermined direction along the first axis when rotating.

In some embodiments, the at least one first air pressure groove is communicated with at least one of the plurality of first blade grooves of the first working portion.

In some embodiments, the rotor assembly further includes a second rotor, which includes a third working portion and a fourth working portion coaxially arranged, where the third working portion is engaged with the first working portion, the fourth working portion is engaged with the second working portion, and both the third working portion and the fourth working portion are rotatable about a second axis.

In some embodiments, the first end face is coated with a wear-resistant coating.

In some embodiments, the first working portion includes a plurality of first helical blades, the plurality of first blade grooves are respectively adjacent to the plurality of first helical blades, the number of the at least one first air pressure groove is multiple, and each of the plurality of first helical blades is provided with at least one first air pressure groove.

In some embodiments, a plurality of first air pressure grooves are helically distributed on the first end face about a center of the first end face.

In some embodiments, the plurality of first air pressure grooves are equal in number to the plurality of first helical blades, each of the plurality of first air pressure grooves is respectively provided on an end face of the corresponding first helical blade, and each of the plurality of first air pressure grooves is respectively communicated with the corresponding first blade groove.

A second aspect of the present disclosure provides a compressor, which includes:

a housing including a first inner wall; and a rotor assembly, which includes:

a first rotor including a first working portion and a second working portion coaxially arranged, where the first working portion and the second working portion are rotatable about a first axis, the first working portion includes a plurality of first helical blades, a first blade groove is formed between adjacent two of the plurality of first helical blades, at least one first air pressure groove is provided on a first end face of the first working portion away from the second working portion, and the first air pressure groove is configured to form a force in a predetermined direction along the first axis when rotating.

In some embodiments, the at least one first air pressure groove is communicated with at least one of the plurality of first blade grooves of the first working portion.

In some embodiments, the rotor assembly further includes a second rotor, which includes a third working portion and a fourth working portion coaxially arranged, where the third working portion is engaged with the first working portion, the fourth working portion is engaged with the second working portion, and both the third working portion and the fourth working portion are rotatable about a second axis.

In some embodiments, the first end face is coated with a wear-resistant coating and/or the first inner wall is coated with the wear-resistant coating.

In some embodiments, the first working portion includes a plurality of first helical blades, the plurality of first blade grooves are respectively adjacent to the plurality of first helical blades, number of the at least one first air pressure groove is multiple, and each of the plurality of first helical blades is provided with at least one first air pressure groove.

In some embodiments, a plurality of first air pressure grooves are helically distributed on the first end face about a center of the first end face.

In some embodiments, the plurality of first air pressure grooves are equal in number to the plurality of first helical blades, each of the plurality of first air pressure grooves is respectively provided on an end face of the corresponding first helical blade, and each of the plurality of first air pressure grooves is respectively communicated with the corresponding first blade groove.

A third aspect of the present disclosure provides a compressor, including the compressor in the second aspect of the present disclosure.

Based on the technical solutions provided by the present disclosure, the rotor assembly includes a first rotor including a first working portion and a second working portion coaxially arranged, where the first working portion and the second working portion are rotatable about a first axis, the first working portion includes a plurality of first helical blades, a first blade groove is formed between adjacent two of the plurality of first helical blades, at least one first air pressure groove is provided on a first end face of the first working portion away from the second working portion, and the first air pressure groove is configured to form a force in a predetermined direction along the first axis when rotating. The first working portion of the compressor of the present disclosure sucks a gas in the first blade groove through the first air pressure groove and pressurizes, thereby forming a fixed gas axial force pointing to the second working portion, to ensure that a rotor shaft system is always only subjected to an axial force in a fixed direction, such that only one set of thrust bearings is needed to bear the gas axial force pointing to the second working portion, thus reducing use of the thrust bearings.

The compressor includes a housing and a rotor assembly, where the housing includes a first inner wall, and the rotor assembly includes a first rotor including a first working portion and a second working portion coaxially arranged in the housing. The first working portion and the second working portion are rotatable about a first axis, the first working portion includes a plurality of first helical blades, and a first blade groove is formed between adjacent two of the plurality of first helical blades. At least one first air pressure groove is provided on a first end face of the first working portion away from the second working portion, the first end face provides a clearance fit with the first inner wall, and the first air pressure groove is configured to form a force in a predetermined direction along the first axis when rotating. The first working portion of the compressor of the present disclosure sucks a gas in the first blade groove through the first air pressure groove and pressurizes, thereby forming a fixed gas axial force pointing to the second working portion, to ensure that a rotor shaft system is always only subjected to an axial force in a fixed direction, such that only one set of thrust bearings is needed to bear the gas axial force pointing to the second working portion, thus reducing use of the thrust bearings. In this way, costs of the compressor may be reduced, volume of the compressor may be reduced, structures of the moving parts of the compressor may be simplified, and the performance and reliability of the compressor may be improved. Furthermore, after the thrust bearing for bearing the gas axial force pointing to the second working portion is eliminated, a layer of gas film formed between the first end face of the first working portion and the first inner wall of the housing can prevent occurrence of malfunction caused by collision and friction between the first rotor and the housing, thus further improving the performance and reliability of the compressor.

BRIEF DESCRIPTION OF THE DRAWINGS

To more clearly describe the technical solutions in the embodiments of the present disclosure, accompanying drawings required for describing the embodiments will be briefly introduced below. Apparently, the accompanying drawings in the following description show merely some embodiments of the present disclosure, and persons of ordinary skill in the art may still derive other drawings from these accompanying drawings without creative efforts.

To more completely understand the present disclosure and its beneficial effects the following description will be made in conjunction with the accompanying drawings, and like reference numerals refer to like parts in the following description.

Figure 1:
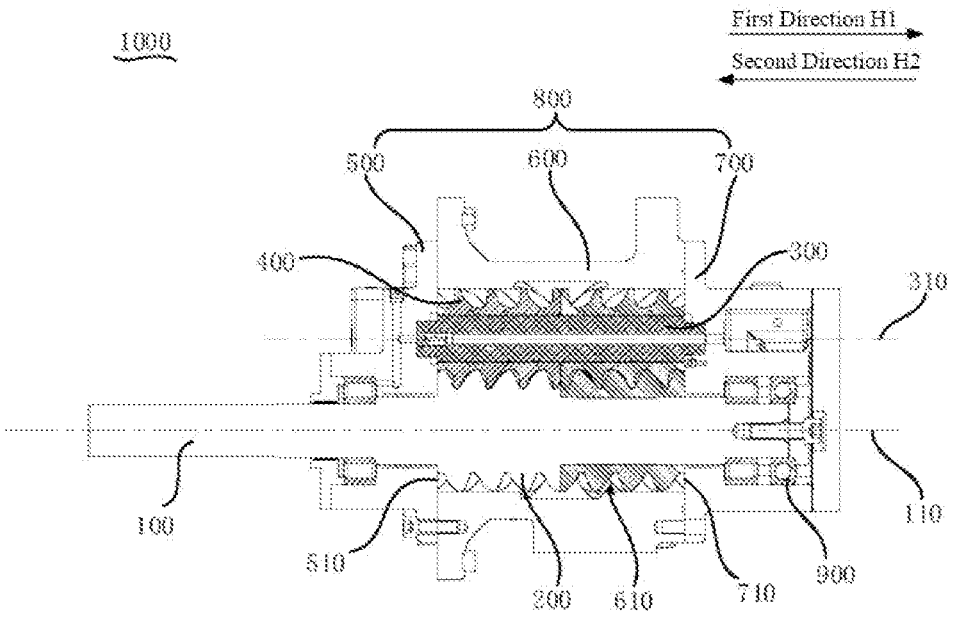
FIG. 1 is a schematic partial structural diagram of a compressor provided by an embodiment of the present disclosure.

Reference numerals in the accompanying drawings: first shaft body 100: first axis 110;

first rotor 200; first working portion 210; first helical blade 211; first blade groove 212; first air pressure groove 213; first end face 214; second working portion 220; second helical blade 221; second blade groove 222; second air pressure groove 223; second end face 224;

second shaft body 300; second axis 310;

second rotor 400; third working portion 410; third helical blade 411; third blade groove 412; third air pressure groove 413; third end face 414; fourth working portion 420; fourth helical blade 421; fourth blade groove 422; fourth air pressure groove 423; fourth end face 424;

first bearing housing 500; first inner wall 510;

rotor housing 600; hollow chamber 610;

second bearing housing 700; second inner wall 710;

housing 800;

thrust bearing 900;

compressor 1000;
rotor assembly 1100;
first direction H1; and
second direction H2.

DESCRIPTION OF THE INVENTION

Technical solutions in the embodiments of the present disclosure will be described clearly and completely below with reference to the accompanying drawings in the embodiments of the present disclosure. Apparently, the described embodiments are merely some but not all of the embodiments of the present disclosure. The following description of at least one exemplary embodiment is in fact merely illustrative and in no way serve as restriction of the present disclosure and its application or use based on the embodiments of the present disclosure. All other embodiments obtained by those skilled in the art without creative efforts fall within the protection scope of the present disclosure.

"Embodiments" or "implementations" herein mean that particular features, structures or characteristics described in conjunction with the embodiments may be included in at least one embodiment of the present disclosure. The phrase appearing in various places in the specification does not necessarily refer to the same embodiment, nor does it refer to an independent or alternative embodiment that is mutually exclusive with other embodiments. It is expressly and implicitly understood by those skilled in the art that the embodiments described herein may be combined with other embodiments.

Referring to FIG. 1, a schematic partial structural diagram of a compressor is provided by an embodiment of the present disclosure. The compressor 1000 shown in FIG. 1 may be a screw compressor. For example, the compressor 1000 is an opposed screw compressor. It is to be noted that the compressor 1000 shown in FIG. 1 is not limited to the screw compressor, and the compressor 1000 may also be, for example, a scroll compressor. The compressor 1000 includes a rotor assembly 1100 comprising a first shaft body 100, a first rotor 200, a second shaft body 300 and a second rotor 400, and a housing 800 enclosed by a first bearing housing 500, a rotor housing 600 and a second bearing housing 700. The rotor housing 600 includes a hollow chamber 610, and at least a portion of the first shaft body 100, the first rotor 200, at least a portion of the second shaft body 300, and the second rotor 400 are housed in the hollow chamber 610 of the rotor housing 600. The first bearing housing 500 covers one end of the rotor housing 600 to form one end of the housing 800, and the second bearing housing 700 covers other end of the rotor housing 600 to form other end of the housing 800.

The first rotor 200 is in meshing transmission with the second rotor 400. In some embodiments of the present disclosure, the first rotor 200 may be a male rotor, and the second rotor 400 may be a female rotor. In other embodiments of the present disclosure, the first rotor 200 may be the female rotor, and the second rotor 400 may be the male rotor. Embodiments of the present disclosure will be described in detail below by taking an example where the first rotor 200 is the male rotor and the second rotor 400 is the female rotor.

The first rotor 200 serving as the male rotor may be understood as a driving rotor, and the second rotor 400 serving as the female rotor may be understood as a driven rotor. For example, the first rotor 200 may be in transmission connection with a drive assembly such as a motor (including but not limited to a permanent magnet motor), the first rotor 200 may be driven by the drive assembly to rotate, and the first rotor 200 may rotate while driving the second rotor 400 to rotate together by means of meshing transmission.

The first rotor 200 is carried by the first shaft body 100 and is fixedly connected to the first shaft body 100. One end of the first shaft body 100 is rotationally mounted on the first bearing housing 500, other end of the first shaft body 100 is rotationally mounted on the second bearing housing 700, and one end of the first shaft body 100 is in transmission connection with the drive assembly. The drive assembly can drive the first shaft body 100 to rotate, and the first shaft body 100 can rotate, together with the first rotor 200 fixedly connected thereto, along a first axis 110 of the first shaft body 100 on the first bearing housing 500 and the second bearing housing 700. That is, the first rotor 200 is rotationally supported on the first bearing housing 500 and the second bearing housing 700. In some embodiments of the present disclosure, the first rotor 200 may be integrally formed with the first shaft body 100. In other embodiments of the present disclosure, the first rotor 200 may be partly integrally formed with the first shaft body 100 and partly sleeved on the first shaft body 100. In other embodiments of the present disclosure, the first rotor 200 may be directly sleeved on the first shaft body 100.

Figure 2:
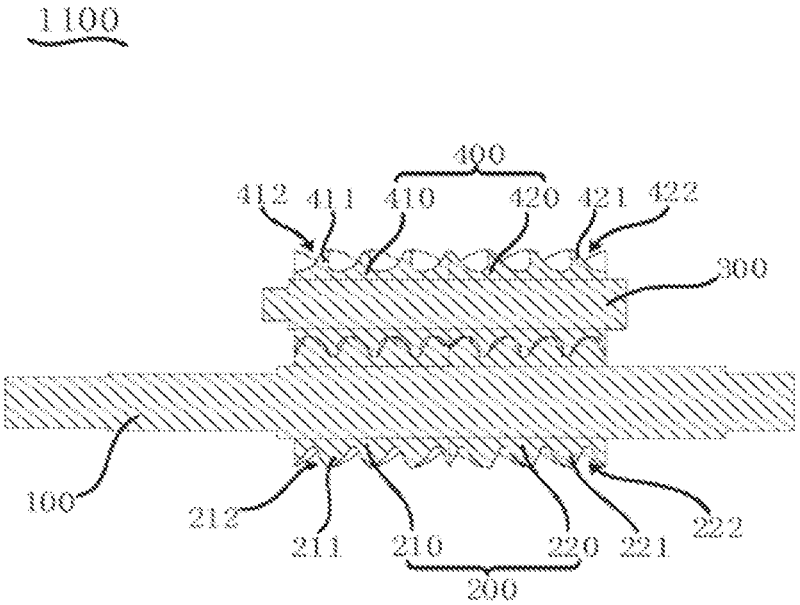
FIG. 2 is a schematic structural diagram of a rotor assembly provided by an embodiment of the present disclosure.

Referring to FIG. 2, a schematic structural diagram of a rotor assembly is provided by an embodiment of the present disclosure. The first rotor 200 may have at least two portions. For example, the first rotor 200 has a first working portion 210 and a second working portion 220 arranged coaxially, where the first working portion 210 of the first rotor 200 is integrally formed with the first shaft body 100, and the second working portion 210 is sleeved on the first shaft body 100 and is adjacent to the first working portion 210. In some embodiments of the present disclosure, an end face of the first working portion 210 adjacent to that of the second working portion 220 may closely fit with each other. In other embodiments of the present disclosure, the end face of the first working portion 210 adjacent to that of the second working portion 220 may not closely fit with each other, instead a smaller gap of such as 0.1 mm, 0.2 mm or 0.3 mm may be provided therebetween.

It is to be understood that in alternative embodiments, both the first working portion 210 and the second working portion 220 may be integrally formed with the first shaft body 100. Alternatively, both the first working portion 210 and the second working portion 220 are sleeved on the first shaft body 100.

With continued reference to FIG. 1 and FIG. 2, the first rotor 200 has helical blades, which may be also referred to as male blades. Specifically, the first working portion 210 has a plurality of first helical blades 211 and a plurality of first blade grooves 212 respectively adjacent to the plurality of first helical blades 211, and one first blade groove 212 is formed between adjacent two of the plurality of first helical blades 211. The second working portion 220 has a plurality of second helical blades 221 and a plurality of second blade grooves 222 respectively adjacent to the plurality of second helical blades 221, and one second blade groove 222 is formed between adjacent two of the plurality of second helical blades 221. The first helical blade 211 and the second helical blade 221 of the embodiments of the present disclosure are configured to have opposite helical directions. When the first rotor 200 and the second rotor 400 are engaged with each other to rotate, opposite axial forces are generated between the first helical blade 211 and the second helical blade 221, which may also be understood as generating opposite axial forces between the first helical blade 211 and the second helical blade 221. Due to symmetry of the axial forces, the opposite axial forces generated between the first helical blade 211 and the second helical blade 221 may be almost counteracted.

It is to be noted that in the description of the present disclosure, "a plurality of" refers to at least two, unless otherwise expressly specified.

With continued reference to FIG. 1 and FIG. 2, the second rotor 400 is carried by and fixedly connected to a second shaft body 300, one end of the second shaft body 300 is rotationally mounted on the first bearing housing 500, and other end of the second shaft body 300 is rotationally mounted on the second bearing housing 700. In an alternative embodiment, the second rotor 400 is carried by and rotationally connected to the second shaft body 300, one end of the second shaft body 300 is fixedly mounted on the first bearing housing 500, and the other end of the second shaft body 300 is fixedly mounted on the second bearing housing 700. The second rotor 400 is in meshing transmission with the first rotor 400, and may be driven by the first rotor 200 to rotate on the first bearing housing 500 and the second bearing housing 700 along a second axis 310 of the second shaft body 300. That is, the second rotor 400 is rotationally supported on the first bearing housing 500 and the second bearing housing 700. In some embodiments of the present disclosure, the second rotor 400 may have at least two portions. For example, the second rotor 400 has a third working portion 410 and a fourth working portion 420 coaxially arranged, both of which are sleeved on the second shaft body 300. The third working portion 410 and the fourth working portion 420 are both rotatable in the housing 800 about the second axis 310.

The third working portion 410 is in meshing transmission with the first working portion 210, and the fourth working portion 420 is in meshing transmission with the second working portion 220. A rotation direction of the third working portion 410 is opposite to that of the first working portion 210, and a rotation direction of the fourth working portion 420 is opposite to that of the second working portion 220.

The second rotor 400 has helical blades, which may be also referred to as female blades. Specifically, the third working portion 410 has a plurality of third helical blades 411 and a plurality of third blade grooves 412 respectively adjacent to the plurality of third helical blades 411, and one third blade groove 412 is formed between adjacent two of the plurality of third helical blades 411. The fourth working portion 420 has a plurality of fourth helical blades 421 and a plurality of fourth blade grooves 422 respectively adjacent to the plurality of fourth helical blades 421, and one fourth blade groove 422 is formed between adjacent two of the plurality of fourth helical blades 421. The third helical blade 411 is engaged with the corresponding first blade groove 212, the first helical blade 211 is engaged with the corresponding third blade groove 412, the fourth helical blade 421 is engaged with the corresponding second blade groove 222, and the second helical blade 221 is engaged with the corresponding fourth blade groove 422. The third helical blade 411 and the fourth helical blade 421 of the embodiments of the present disclosure are configured to have opposite helical directions. When the first rotor 200 and the fourth rotor 400 are engaged with each other to rotate, opposite axial forces are generated between the third helical blade 411 and the fourth helical blade 421, which may also be understood as generating opposite axial forces between the third helical blade 411 and the fourth helical blade 421. Due to symmetry of the axial forces, the opposite axial forces generated between the third helical blade 411 and the fourth helical blade 421 may be almost counteracted.

It is to be noted that the terms "first", "second", "third", and "fourth" in the specification and the claims of the present disclosure are used for distinguishing between different objects rather than describing a particular order. Furthermore, the terms "comprise" and "have" as well as variants thereof are intended to cover non-exclusive inclusion.

For the first rotor 200 and the second rotor 400, when the first rotor 200 and the second rotor 400 rotate together by meshing with each other, opposite axial forces may be generated due to opposite rotation directions between the first working portion 210 and the second working portion 220, and opposite axial forces may be generated due to opposite rotation directions between the third working portion 410 and the fourth working portion 420, the axial forces between the first working portion 210 and the second working portion 220 may be counteracted to a certain extent, and the axial forces between the third working portion 410 and the fourth working portion 420 may be counteracted to a certain extent.

However, it is to be noted that in actual production processes, it is found that, in one aspect, due to a problem of manufacturing deviation, there are some differences in configurations of different parts of the first rotor 200 and some differences in configurations of different parts of the second rotor 400. Also, there are some differences between the first rotor 200 and the second rotor 400. In another aspect, due to problems of tolerance and deviation in assembly, there are some differences in fitting between the first rotor 200 and the second rotor 400. This leads to impossible complete counteraction of the axial forces between the first working portion 210 and the second working portion 220 and impossible complete counteraction of the axial forces between the third working portion 410 and the fourth working portion 420. Thus, it is impossible to form a resultant force of the axial forces in a random direction because of impossible almost complete counteraction of the axial forces when the first rotor 200 and the second rotor 400 are engaged with each other to rotate together. The resultant force of the axial forces may point to a first direction H1, and the resultant force of the axial forces may also point to a second direction H2.

In a further aspect, in quantification of compressor products, differences between the rotors in each compressor lead to different directions of the resultant force of the axial forces generated by the rotors in each compressor. For example, the directions of the resultant forces of the axial forces of the rotors in some compressors face the first direction H1, and the directions of the resultant forces of the axial forces of the rotors in some other compressors face the second direction H2. That is, a resultant force which is random in axial direction and random in numerical value appears in a whole rotor shaft system, such that the whole rotor shaft system is randomly pushed to one of the first bearing housing 500 and the second bearing housing 700, which causes contact and friction between a rotor surface of this side and the housing, and thus resulting in occurrence of failure.

In the related technologies, to ensure stable operation of all the formed compressors, two sets of thrust bearings (or referred to as axial thrust bearings) are sleeved on each shaft body of each compressor to limit the resultant forces of the axial forces of the rotors in all the formed compressors. In this way, the stable operation of all the formed compressors can be ensured.

Therefore, it is still inevitable to use the thrust bearings to carry a limiting load. However, due to the randomness of the direction of the resultant force, the thrust bearings need to be able to carry the limiting load in two directions. That is, to ensure the restriction of the resultant force of the axial forces of the rotors during actual production and processing processes of the compressor, thrust bearings (axial thrust bearings) are still required to be installed on one rotating shaft to limit two directions. For example, the compressor may be provided with two sets of thrust bearings having opposite bearing directions to ensure that the resultant force of the axial forces randomly appearing in the two directions is borne. However, for one individual compressor, the direction of its random resultant force of the axial forces is always unchanged. In this case, one set of thrust bearings is used for limiting, while the other set of thrust bearings is completely idle, thus resulting in lower price-performance ratio. Furthermore, redundant mechanical losses and demands for lubricating oil are incurred, and a failure rate of the compressor is increased. Finally, sizes and costs of compressor assembly are increased, and mechanical efficiency of operation of the rotor shaft system is reduced to a certain extent, and the demands for the lubricating oil are increased.

Figure 3:
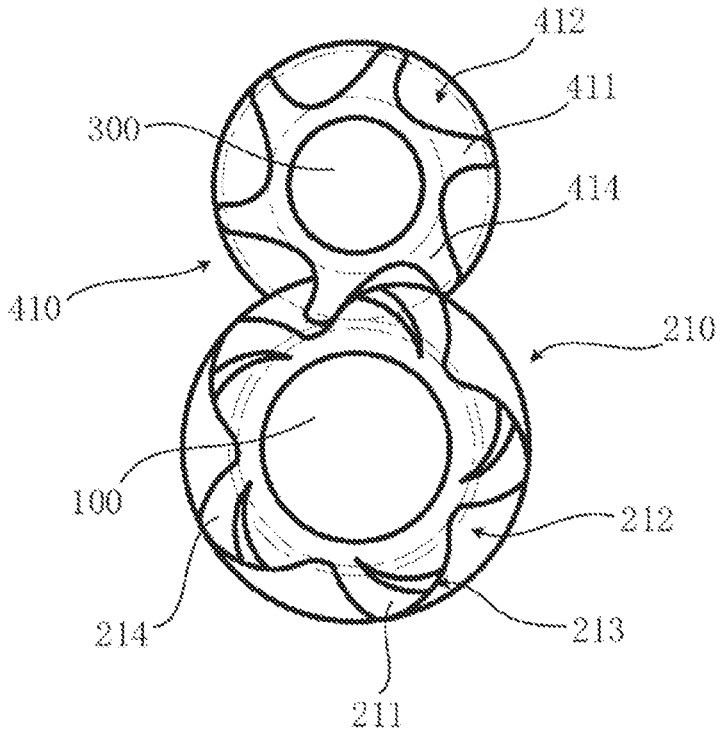
FIG. 3 is an end view showing an end of a first rotor and a second rotor of a first type of rotor assembly provided by an embodiment of the present disclosure.

On this basis, reference is made to FIG. 3, which is an end view showing an end of a first rotor and a second rotor of a first type of rotor assembly provided by an embodiment of the present disclosure. With reference to FIG. 2, at least one first air pressure groove 213 is provided on a first end face 214 of the first working portion 210 away from the second working portion 220, the at least one first air pressure groove 213 is respectively communicated with at least one of the plurality of first blade grooves 212 of the first working portion 210, and the first air pressure groove 213 is configured to form a force in a predetermined direction along the first axis 110 when rotating.

The first end face 214 provides a clearance fit with the first inner wall 510 of the first bearing housing 500. When the first working portion 210 and the second working portion 220 rotate about the first axis 110, the at least one first air pressure groove 213 sucks a gas from at least one of the plurality of first blade grooves 212 and pressurizes to form a layer of gas film between the first end face 214 and the first inner wall 510 to prevent the first working portion 210 from abutting against the first inner wall 510.

The first working portion 210 of the compressor 1000 in the embodiments of the present disclosure sucks a gas from the first blade groove 212 through the first air pressure groove 213 and pressurizes, thereby forming a fixed gas axial force pointing to the second working portion 220, to ensure that the rotor shaft system is always only subjected to an axial force in a fixed direction, such that only one set of thrust bearings 900 is needed to bear the gas axial force pointing to the second working portion, thus reducing use of the thrust bearings 220. In this way, costs of the compressor 1000 may be reduced, volume of the compressor 1000 may be reduced, structures of the moving parts of the compressor 1000 may be simplified, and the performance and reliability of the compressor 1000 may be improved. Furthermore, after the thrust bearing for bearing the gas axial force pointing to the second working portion 220 is eliminated, a layer of gas film formed between the first end face 214 of the first working portion 210 and the first inner wall 510 of the housing 800 can prevent occurrence of malfunction caused by collision and friction between the first rotor 200 and the housing 800, thus further improving the performance and reliability of the compressor 1000.

Figure 4:
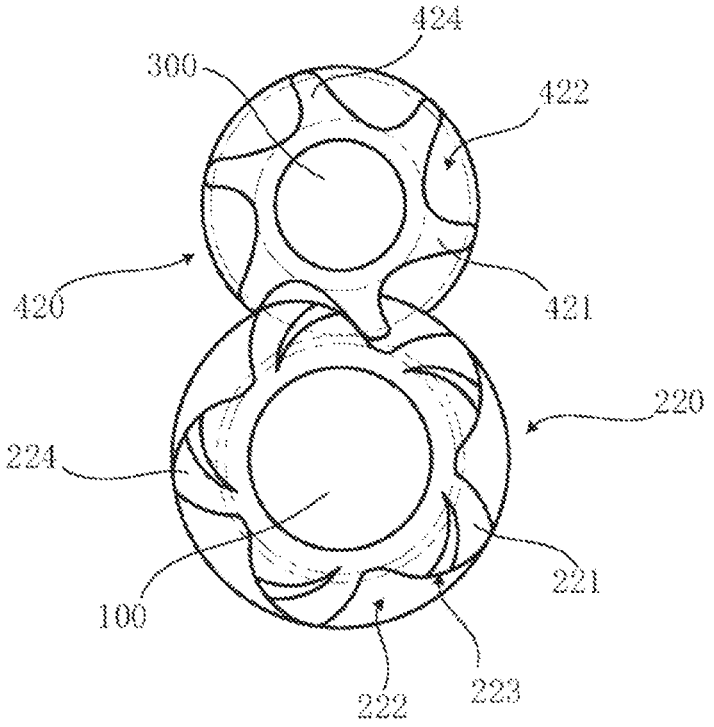
FIG. 4 is an end view showing other end of a first rotor and a second rotor of a second type of rotor assembly provided by an embodiment of the present disclosure.

On the basis of the aforementioned first type of rotor assembly, further, reference is made to FIG. 4, which is an end view showing the other end of a first rotor and a second rotor of a second type of rotor assembly provided by an embodiment of the present disclosure. With reference to FIG. 4, at least one second air pressure groove 223 is provided on a second end face 224 of the second working portion 220 away from the first working portion 210, the at least one second air pressure groove 223 is respectively communicated with at least one of the plurality of second blade grooves 222 of the second working portion 220, and the second air pressure groove 223 is configured to form a force in a predetermined direction along the first axis 110 when rotating.

The second end face 224 provides a clearance fit with a second inner wall 710 of the second bearing housing 700, and the second inner wall 710 is spaced from and arranged opposite to the first inner wall 510. When the first working portion 210 and the second working portion 220 rotate about the first axis 110, the at least one second air pressure groove 223 respectively sucks a gas from at least one of the plurality of second blade grooves 222 and pressurizes to form a layer of gas film between the second end face 224 and the second inner wall 710 to prevent the second working portion 220 from abutting against the second inner wall 710.

The first working portion 210 of the compressor 1000 in the embodiments of the present disclosure sucks the gas from the first blade groove 212 through the first air pressure groove 213 and pressurizes, thereby forming a fixed gas axial force pointing to the second working portion 220. The second working portion 220 of the compressor 1000 sucks the gas from the second blade groove 222 through the second air pressure groove 223 and pressurizes, thereby forming a fixed gas axial force pointing to the first working portion 210. The gas axial forces in the two directions can balance the axial force applied to the first rotor 200, such that the thrust bearing provided on the first shaft body 100 can be further completely eliminated. The embodiments of the present disclosure can further reduce the costs of the compressor 1000, reduce the volume of the compressor 1000, simplify the structures of the moving parts of the compressor 1000, and improve the performance and reliability of the compressor 1000. Furthermore, after the thrust bearings respectively for bearing the gas axial forces pointing to two ends of the first rotor 200 are eliminated, the gas film formed between the first end face 214 and the first bearing housing 500 and the gas film formed between the second end face 224 and the second bearing housing 700 can prevent occurrence of malfunction caused by collision and friction between two ends of the first rotor 200 and the first bearing housing 500 and the second bearing housing 700, thus further improving the performance and reliability of the compressor 1000.

Figure 5:
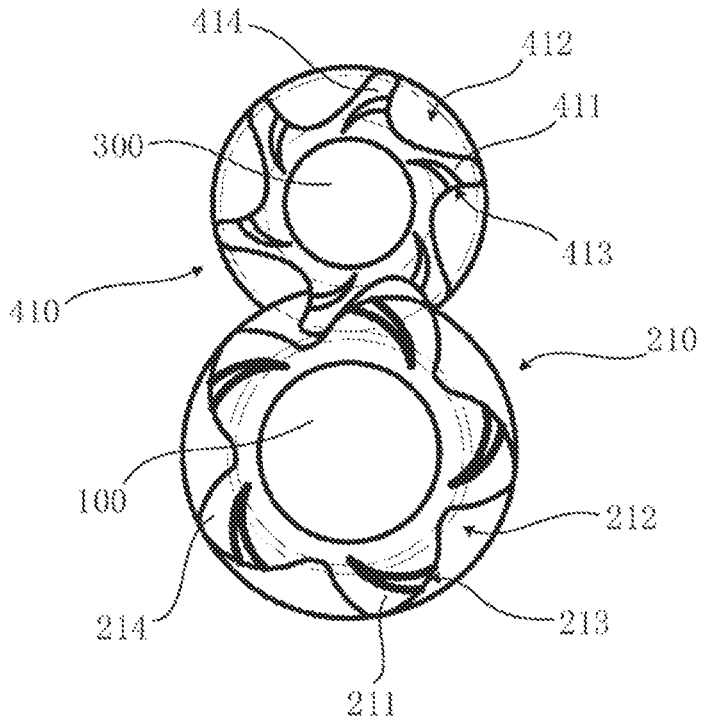
FIG. 5 is an end view showing an end of a first rotor and a second rotor of a third type of rotor assembly provided by an embodiment of the present disclosure.

On the basis of the aforementioned first type of rotor assembly, further, reference is made to FIG. 5, which is an end view showing one end of a first rotor and a second rotor of a third type of rotor assembly provided by an embodiment of the present disclosure. With reference to FIG. 5, at least one third air pressure groove 413 is provided on a third end face 414 of the third working portion 410 away from the fourth working portion 420, the at least one third air pressure groove 413 is respectively communicated with at least one of the plurality of third blade grooves 412 of the third working portion 410, and the third air pressure groove 413 is configured to form a force in a predetermined direction along the second axis 310 when rotating.

The third end face 414 provides a clearance fit with the first inner wall 510 of the first bearing housing 500. When the third working portion 410 and the fourth working portion 420 rotate about the second axis 310, the at least one third air pressure groove 413 sucks a gas from at least one of the plurality of third blade grooves 412 and pressurizes to form a layer of gas film between the third end face 414 and the first inner wall 510 to prevent the third working portion 410 from abutting against the first inner wall 510.

The first working portion 210 of the compressor 1000 in the embodiments of the present disclosure sucks the gas from the first blade groove 212 through the first air pressure groove 213 and pressurizes, and the third working portion 410 sucks the gas from the third blade groove 412 through the third air pressure groove 413 and pressurizes, thereby forming a fixed gas axial force pointing to the second working portion 220 and the fourth working portion 420, to ensure that the rotor shaft system is always only subjected to an axial force in a fixed direction, such that only one set of thrust bearings is needed to be provided on the first shaft body 100 and the second shaft body 300 respectively to bear the gas axial force pointing to the second working portion 220 and the fourth working portion 420, thus reducing use of the thrust bearings. The embodiments of the present disclosure can reduce the costs of the compressor 1000, reduce the volume of the compressor 1000, simplify the structures of the moving parts of the compressor 1000, and improve the performance and reliability of the compressor 1000. Furthermore, after the thrust bearing for bearing the gas axial force pointing to the second working portion 220 and the fourth working portion 420 is eliminated, the gas film formed between the first end face 214 and the first bearing housing 500 and the gas film formed between the second end face 224 and the first bearing housing 500 can prevent occurrence of malfunction caused by collision and friction between the first rotor 200 or the second rotor 400 and the first bearing housing 500, thus further improving the performance and reliability of the compressor 1000.

Figure 6:
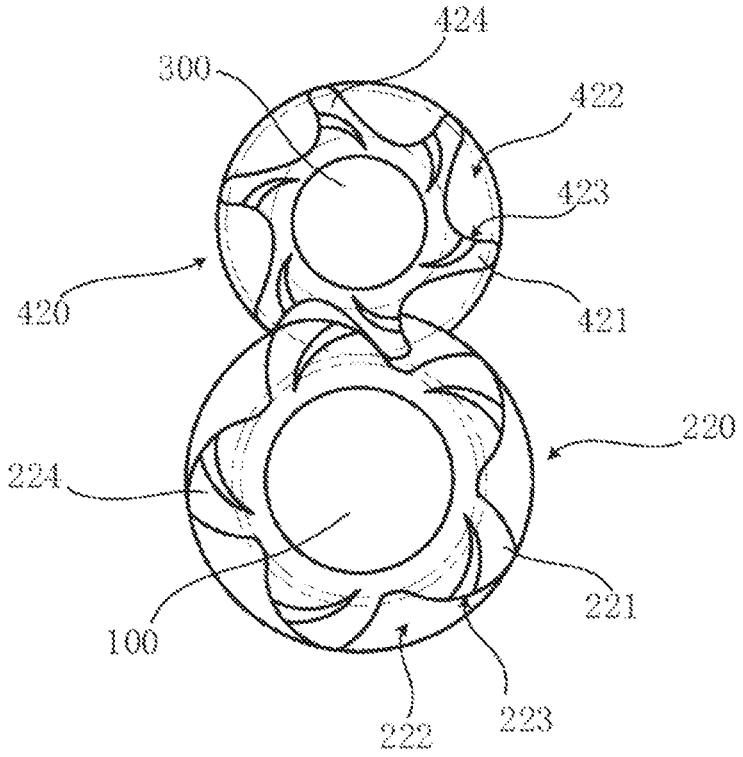
FIG. 6 is an end view showing other end of a first rotor and a second rotor of a fourth type of rotor assembly provided by an embodiment of the present disclosure.

On the basis of the aforementioned second type of rotor assembly, further, reference is made to FIG. 6, which is an end view showing other end of a first rotor and a second rotor of the second type of rotor assembly provided by an embodiment of the present disclosure. With reference to FIG. 2, at least one third air pressure groove 413 is provided on a third end face 414 of the third working portion 410 away from the fourth working portion 420, and the at least one third air pressure groove 413 is respectively communicated with at least one of the plurality of third blade grooves 412 of the third working portion 410. At least one fourth air pressure groove 423 is provided on a fourth end face 424 of the fourth working portion 420 away from the third working portion 410, the at least one fourth air pressure groove 423 is respectively communicated with at least one of the plurality of fourth blade grooves 422 of the fourth working portion 420, and the fourth air pressure groove 423 is configured to form a force in a predetermined direction along the second axis 310 when rotating.

The third end face 414 provides a clearance fit with the first inner wall 510 of the first bearing housing 500, and the fourth end face 424 provides a clearance fit with the second inner wall 710 of the second bearing housing 700. When the third working portion 410 and the fourth working portion 420 rotate about the second axis 310, at least one third air pressure groove 413 sucks the gas from at least one of the plurality of third blade grooves 412 and pressurizes to form a layer of gas film between the third end face 414 and the first inner wall 510 to prevent the third working portion 410 from abutting against the first inner wall 510, and at least one fourth air pressure groove 423 sucks the gas from at least one of the plurality of fourth blade grooves 422 and pressurizes to form a layer of gas film between the fourth end face 424 and the second inner wall 710 to prevent the fourth working portion 420 from abutting against the second inner wall 710.

The first working portion 210 of the compressor 1000 in the embodiments of the present disclosure sucks the gas from the first blade groove 212 through the first air pressure groove 213 and pressurizes, thereby forming a fixed gas axial force pointing to the second working portion 220. The second working portion 220 of the compressor 1000 sucks the gas from the second blade groove 222 through the second air pressure groove 223 and pressurizes, thereby forming a fixed gas axial force pointing to the first working portion 210. The gas axial forces in the two directions can balance the axial force applied to the first rotor 200, such that the thrust bearing provided on the first shaft body 100 can be further completely eliminated. Furthermore, the third working portion 410 of the compressor 1000 sucks the gas from the third blade groove 413 through the third air pressure groove 413 and pressurizes, thereby forming a fixed gas axial force pointing to the second working portion 220. The fourth working portion 420 of the compressor 1000 sucks the gas from the fourth blade groove 422 through the fourth air pressure groove 423 and pressurizes, thereby forming a fixed gas axial force pointing to the first working portion 210. The gas axial forces in the two directions can balance the axial force applied to the second rotor 400, such that the thrust bearing provided on the second shaft body 300 can be further completely eliminated. The embodiments of the present disclosure can further reduce the costs of the compressor 1000, reduce the volume of the compressor 1000, simplify the structures of the moving parts of the compressor 1000, and improve the performance and reliability of the compressor 1000, Furthermore, after the thrust bearings respectively for bearing the gas axial forces pointing to two ends of the first rotor 200 and two ends of the second rotor 400 are eliminated, the gas film formed between the two ends of the first rotor 200 and the first bearing housing 500 and the gas film formed between the two ends of the second rotor 400 and the second bearing housing 700 can prevent occurrence of malfunction caused by collision and friction between the two ends of the first rotor 200 and the first bearing housing 500 and between the two ends of the second rotor 400 and the second bearing housing 700, thus further improving the performance and reliability of the compressor 1000.

In some embodiments, the first end face 214, the second end face 224, the third end face 414, the fourth end face 424 and/or the first inner wall 510 and the second inner wall 710 are coated with a wear-resistant coating, respectively. The wear-resistant coating may be formed by spraying ceramics, alloys, oxides, fluoroplastics, etc. on the first end face 214, the second end face 224, the third end face 414, the fourth end face 424 and/or the first inner wall 510 and the second inner wall 710 by means of plasma spraying, electric arc spraying, or flame spraying. The wear-resistant coating may also be formed by coating as a wear-resistant coating adhesive made up of various resins, elastomers or the like to the first end face 214, the second end face 224, the third end face 414, the fourth end face 424 and/or the first inner wall 510 and the second inner wall 710, and then naturally curing the wear-resistant coating adhesive or curing the wear-resistant coating adhesive by heating.

In the embodiments of the present disclosure, by coating the wear-resistant coating on the first end face 214, the second end face 224, the third end face 414, the fourth end face 424 and/or the first inner wall 510 and the second inner wall 710, it can be ensured that the gas films at the two ends of the first rotor 200 and the second rotor 400 have sufficient acting forces applied to the first rotor 200 and the second rotor 400 in an initial startup phase or a shutdown phase of the compressor 1000, which can prevent the occurrence of malfunction caused by collision between the two ends of the first rotor 200 and the first bearing housing 500 and by collision between the two ends of the second rotor 400 and the second bearing housing 700, thus further improving the performance and reliability of the compressor 1000.

In some embodiments, a clearance between the first end face 214 or the third end face 414 and the first inner wall 510 ranges from 3 microns to 5 microns, and a clearance between the second end face 224 or the fourth end face 424 and the second inner wall 710 ranges from 3 microns to 5 microns. In the embodiments of the present disclosure, by setting the clearance between the first end face 214 or the third end face 414 and the first inner wall 510 to ranges from 3 microns to 5 microns, and setting the clearance between the second end face 224 or the fourth end face 424 and the second inner wall 710 to range from 3 microns to 5 microns, it can be ensured that the gas films at the two ends of the first rotor 200 and the gas films at the two ends of the second rotor 400 have higher stiffness. Furthermore, end faces at the two ends of the first rotor 200 and end faces at the two ends of the second rotor 400 are completely separated from the first bearing housing 500 and the second bearing housing 700 respectively, and thus neither collision nor friction may occur.

In some embodiments, as shown in FIGS. 3 to 6, the number of the at least one first air pressure grooves 213, the number of the at least one second air pressure grooves 223, the number of the at least one third air pressure grooves 413, and the number of the at least one fourth air pressure grooves 423 are multiple. The plurality of first air pressure grooves 213 are equal in number to the plurality of first helical blades 211, the plurality of second air pressure grooves 223 are equal in number to the plurality of second helical blades 221, the plurality of third air pressure grooves 413 are equal in number to the plurality of third helical blades 411, and the plurality of fourth air pressure grooves 423 are equal in number to the plurality of fourth helical blades 421.

In some embodiments, as shown in FIGS. 3 to 6, the plurality of first air pressure grooves 213 are helically distributed on the first end face 214 about a center of the first end face 214, the plurality of second air pressure grooves 223 are helically distributed on the second end face 224 about a center of the second end face 224, the plurality of third air pressure grooves 413 are helically distributed on the third end face 414 about a center of the third end face 414, and the plurality of fourth air pressure grooves 423 are helically distributed on the fourth end face 424 about a center of the fourth end face 424.

In some embodiments, as shown in FIGS. 3 to 6, each of the plurality of first air pressure grooves 213 is respectively provided on the end face of the corresponding first helical blade 211, and each of the plurality of first air pressure grooves 213 is respectively communicated with the corresponding first blade groove 212. Each of the plurality of second air pressure grooves 223 is respectively provided on the end face of the corresponding second helical blade 221, and each of the plurality of second air pressure grooves 223 is respectively communicated with the corresponding second blade groove 222. Each of the plurality of third air pressure grooves 413 is respectively provided on the end face of the corresponding third helical blade 411, and each of the plurality of third air pressure grooves 413 is respectively communicated with the corresponding third blade groove 412. Each of the plurality of fourth air pressure grooves 423 is respectively provided on the end face of the corresponding fourth helical blade 421, and each of the plurality of fourth air pressure grooves 423 is respectively communicated with the corresponding fourth blade groove 422.

The compressor 1000 in one or more of the above embodiments may be applied to an air conditioner.

The embodiments of the present disclosure also provide an air conditioner, which includes the compressor 1000 as defined by one or more of the above embodiments in combination.

Detailed description of the rotor assembly, the compressor and the air conditioner provided by the embodiments of the present disclosure is made hereinabove, elaboration of the principle and implementations of the present disclosure is made by using specific examples herein, and the description of the foregoing embodiments is merely intended to assist in understanding the method of the present disclosure and a core concept thereof. Also, those of ordinary skill in the art may change, in according with the core concept of the present disclosure, concrete implementations and scope of application. In conclusion, contents of the specification shall not be interpreted as limiting the present disclosure.

The invention claimed is:

1. A rotor assembly, comprising:

a first bearing housing including a first inner wall, a first rotor having a first end face; and a clearance fit space formed between the first inner wall and the entire first end face, the first rotor comprising:

a first working portion and a second working portion coaxially arranged, the first working portion and the second working portion are rotatable about a first axis and have opposite helical directions, the first working portion includes:

a plurality of first helical blades, a first blade groove is formed between adjacent two of the plurality of first helical blades, and at least one first air pressure groove is provided on the first end face of the first working portion away from the second working portion, and the at least one first air pressure groove sucks gas from the first blade groove that fills the at least one first air pressure groove so as to pressurize the at least one first air pressure groove, and the pressurized at least one first air pressure groove further forms a layer of pressurized gas film in the clearance fit space along the entire first end face, wherein the pressurized at least one first air pressure groove is configured to form a force towards the second working portion along the first axis when the first rotor rotates, wherein the layer of pressurized gas film is configured to prevent the first working portion of the first rotor from having engaged abutting contact against the first inner wall of the first bearing housing, and wherein the at least one first air pressure groove is arcuate with a wide base adjacent to the first respective blade groove and tapers to a point.

2. The rotor assembly according to claim 1, further comprising a second rotor comprising a third working portion and a fourth working portion coaxially arranged, wherein the third working portion is engaged with the first working portion, the fourth working portion is engaged with the second working portion, and both the third working portion and the fourth working portion are rotatable about a second axis.

3. The rotor assembly according to claim 1, wherein the first end face is coated with a wear-resistant coating.

4. The rotor assembly according to claim 1, wherein the at least one first air pressure groove comprises a plurality of first air pressure grooves, and each of the plurality of first helical blades is provided with at least one of the plurality of the first air pressure grooves.

5. The rotor assembly according to claim 1, wherein the at least one first air pressure groove comprises a plurality of first air pressure grooves, the plurality of the first air pressure grooves are helically distributed on the first end face about a center of the first end face.

6. The rotor assembly according to claim 1, wherein the at least one first air pressure groove comprises a plurality of first air pressure grooves, the plurality of first air pressure grooves are equal in number to the plurality of first helical blades, each of the plurality of first air pressure grooves is respectively provided on an end face of a corresponding first helical blade, and each of the plurality of first air pressure grooves is respectively communicated with a corresponding first blade groove.

7. A compressor, comprising:

a housing comprising a first inner wall; and a rotor assembly comprising:

a first bearing housing including the first inner wall, a first rotor having a first end face; and a clearance fit space formed between the first inner wall and the entire first end face, the first rotor comprising:

a first working portion and a second working portion coaxially arranged in the housing, the first working portion and the second working portion are rotatable about a first axis and have opposite helical axis, the first working portion includes:

a plurality of first helical blades, a first blade groove is formed between adjacent two of the plurality of first helical blades, and at least one first air pressure groove is provided on the first end face of the first working portion away from the second working portion, and the first air pressure groove sucks gas from the first blade groove that fills the at least one first air pressure groove so as to pressurize the first air pressure groove, and the pressurized at least one first air pressure groove further forms a layer of pressurized gas film in the clearance fit space along the entire first end face, wherein the pressurized at least one first air pressure groove is configured to form a force towards the second working portion along the first axis when the first rotor rotates, wherein the layer of pressurized gas film is configured to prevent the first working portion of the first rotor from having engaged abutting contact against the first inner wall of the first bearing housing, and wherein the at least one first air pressure groove is arcuate with a wide base adjacent to the first respective blade groove and tapers to a point.

8. The compressor according to claim 7, wherein the rotor assembly further comprises a second rotor comprising a third working portion and a fourth working portion coaxially arranged, the third working portion is engaged with the first working portion, the fourth working portion is engaged with the second working portion, and both the third working portion and the fourth working portion are rotatable about a second axis.

9. The compressor according to claim 7, wherein the first end face is coated with a wear-resistant coating and/or the first inner wall is coated with the wear-resistant coating.

10. The compressor according to claim 7, wherein the at least one first air pressure groove comprises a plurality of first air pressure grooves, and each of the plurality of first helical blades is provided with at least one of the plurality of the first air pressure grooves.

11. The compressor according to claim 7, wherein the at least one first air pressure groove comprises a plurality of first air pressure grooves, the plurality of the first air pressure grooves are helically distributed on the first end face about a center of the first end face.

12. The compressor according to claim 7, wherein the at least one first air pressure groove comprises a plurality of first air pressure grooves, the plurality of first air pressure grooves are equal in number to the plurality of first helical blades, each of the plurality of first air pressure grooves is respectively provided on an end face of a corresponding first helical blade, and each of the plurality of first air pressure grooves is respectively communicated with a corresponding first blade groove.

13. An air conditioner comprising the compressor according to claim 7.

* * * * *